US012402676B1

(12) United States Patent
Lin

(10) Patent No.: US 12,402,676 B1
(45) Date of Patent: Sep. 2, 2025

(54) GLOVE WITH STITCHLESS SEAMS

(71) Applicants: Wan-Yang Lin, New Taipei (TW); EMINENCE INTERNATIONAL TRADING CO., LTD., New Taipei (TW); SUMMER SMILE INTERNATIONAL CO., Taichung (TW)

(72) Inventor: Wan-Yang Lin, New Taipei (TW)

(73) Assignees: Wan-Yang Lin, New Taipei (TW); EMINENCE INTERNATIONAL TRADING CO., LTD., New Taipei (TW); SUMMER SMILE INTERNATIONAL CO., Taichung (TW)

( * ) Notice: Subject to any disclaimer, the term of this patent is extended or adjusted under 35 U.S.C. 154(b) by 0 days.

(21) Appl. No.: 18/592,545

(22) Filed: Mar. 1, 2024

(51) Int. Cl.
*A41D 19/015* (2006.01)
*A41D 19/00* (2006.01)
*A41F 1/06* (2006.01)

(52) U.S. Cl.
CPC ... *A41D 19/0017* (2013.01); *A41D 19/01535* (2013.01); *A41F 1/06* (2013.01); *A41D 2300/32* (2013.01); *A41D 2400/10* (2013.01)

(58) Field of Classification Search
CPC .. A41D 19/0048; A41D 19/02; A41D 19/001; A41D 19/0017; A41F 1/06
USPC ..... 2/159–169
See application file for complete search history.

(56) References Cited

U.S. PATENT DOCUMENTS 5,500,956 A * 3/1996 Schulkin ..... A63B 71/148 2/161.3
10,342,273 B2 * 7/2019 Cai ..... A41D 19/0006
2013/0283498 A1 * 10/2013 Hewitt ..... A41D 19/0048 2/163

* cited by examiner

*Primary Examiner* — Katherine M Moran
(74) *Attorney, Agent, or Firm* — Fei-hung Yang

(57) ABSTRACT

A seamless glove includes a base fabric, a thumb fabric, a finger fabric and a wrist fabric. The base fabric has a palm section, a thumb section and a finger section. The finger fabrics are respectively configured to be corresponsive to the finger sections and extended to a part of the palm section, and a first fold section between the thumb section and the adjacent finger section and a second fold section between two adjacent finger sections press towards the palm section to cover and adhere the finger fabrics, so an external surface formed by adhering the base fabric, the thumb fabric, and the finger fabric is defined as a lining of a semi-finished glove. The wrist fabric is in a strip form and adhered around the semi-finished glove. Therefore, an excellent skin feel for the open-finger glove product is provided.

6 Claims, 5 Drawing Sheets

GLOVE WITH STITCHLESS SEAMS

BACKGROUND OF THE DISCLOSURE

Technical Field

The present disclosure relates to the technical field of glove products, and particularly relates to a seamless glove with a special adhesive structure that provides a smooth comfortable feel on the skin during its use.

Description of the Related Art

Gloves can be deemed a form of protective device used to provide a protection with a certain degree against injuries at work, in environment, or in fighting. The design and manufacturing techniques and processes of the gloves have evolved over time and mass production has begun. Industrialized production made gloves more common and accessible to a wide variety of occupational areas, such as the industrial, agricultural, and medical areas. Now, the glove materials have become more diverse, for example, rubber, plastic or synthetic fibers are common choices to meet the needs of different environments and applications. In addition, the common types of gloves divided according to application and function include cold weather gloves, sports gloves, cleaning gloves, medical gloves, etc., which come with different designs to cope with various specific environments and applications.

However, there are still some drawbacks that need to be overcome while satisfying the diverse needs of gloves and one of the major issues is comfort. Comfort is a key factor in glove products that should not be overlooked to ensure that the users feel comfortable while wearing the gloves without affecting the users' operational flexibility. However, most of the existing glove products made of fabric material are made by sewing, so that there is no way to break through the technological mold in manufacturing, resulting in the fabric gloves will still cause user discomfort due to the seam structure, and there is no superior performance in the comfort part, and it is easy to affect the users' freedom of hand movements because of the seam, which is even more prominent in the work or sports that require a high degree of flexibility. This is a major drawback of the glove products in work or sports situations that require a high degree of flexibility.

Therefore, how to provide users with a glove product that has high comfort and flexibility while retaining the necessary protective properties demand immediate attention and feasible solution. In view of the aforementioned drawbacks of the related art, the present discloser based on years of experience in the related industry to conceive and propose a seamless glove, which effectively overcomes the existing drawbacks and provides a more comfortable glove product to satisfy the user and market demands for the related products.

SUMMARY OF THE DISCLOSURE

The primary objective of the present disclosure is to provide a seamless glove that uses special fabric materials and adhesion methods to achieve the effect of high wearing comfort and flexibility.

To achieve the aforementioned objective, the present disclosure discloses a seamless glove, including: a base fabric, having a palm section, a thumb section and a plurality of finger sections, the thumb section and the finger sections being connected to the palm section; wherein a first fold section is formed between the thumb section and its adjacent finger section, and a second fold section is formed between two adjacent finger sections; a thumb fabric in a shape corresponding to the shape of the thumb section, and having a width greater than the width of the thumb section, an open finger end of the thumb fabric being aligned precisely with an open finger end of the thumb section, and two sides of the thumb fabric partially covering and adhering the thumb section; a plurality of finger fabrics, respectively configured to be corresponsive to the finger sections and extending to a part of the palm section, and the positions where the finger fabrics are extend to the palm section being mutually stacked and adhered positions to totally cover the palm section; wherein the open finger ends of the finger fabrics are respectively and precisely aligned with the open finger ends of the finger sections, and the positions where two sides of the finger fabrics corresponding to the finger sections respectively and partially cover and adhere the finger sections, the finger fabrics corresponding to two sides of the palm section partially cover and adhere the palm section, and the first fold section and the second fold section pressing towards the palm section to cover and adhere the finger fabrics, so that an external surface formed by the base fabric, the thumb fabric and the finger fabrics is defined as a semi-finished glove lining; and a wrist fabric, which is strip-shaped and adhered around a bottom edge of the semi-finished glove after the semi-finished glove is turned inside out to make the lining inside the semi-finished glove. In this way, the seamless glove uses a special adhesion method to eliminate the discomfort caused by the stitches of the traditional gloves and greatly improve the users' wearing comfort.

Preferably, the finger sections include an index-finger section and a middle-finger section, the finger fabrics include an index-finger fabric and a middle-finger fabric, and the middle-finger section is connected to the palm section to form a shallow arc section, the middle-finger fabric corresponding to the shallow arc section of the middle-finger section is formed with a deep arc section, so as to produce a three-finger covering-type glove product.

Preferably, the index-finger fabric corresponding to the junction of the index-finger section and the palm section is provided with two cut lines to facilitate the index-finger fabric to partially cover the finger section.

Preferably, the first fold section and the second fold section are both in a triangular shape, which provides a better pressing and covering effect for the palm section as well as facilitating the cut manufacturing of the base fabric.

Preferably, two ends of the wrist fabric are provided with a child fastening part and a parent fastening part respectively to facilitate enhancing the stability of wearing.

Preferably, the child fastening part and the parent fastening part are hook and loop fasteners, which have the advantage of quick fixation and removal.

Preferably, the base fabric, the thumb fabrics are the finger fabrics are made of a heating material to provide an excellent warming effect.

In summation of the description above, the seamless glove of the present disclosure bases on the structure and method of adhering the base fabric, the thumb fabric, the finger fabric and the wrist fabric together to form a seamless structure, so that users can have excellent comfort of wearing due to the seamless structure. Specifically, the thumb fabric and the finger fabrics partially cover and adhere the thumb section, finger section, and palm section of the base fabric, so that the thumb fabric and the finger fabric are tightly and stably adhered and fixed to the base fabric, especially the finger fabric, which partially covers and adheres the palm section of the base fabric, such that the three fabrics can be adhered and fixed by this special method to form a semi-finished glove lining. Finally, the glove is turned inside out, and the lining is placed inside the glove from the wrist fabric and adhered around the glove to form the seamless glove. The present disclosure has disclosed a novel technical solution of a glove structure with high comfort. Further, the present disclosure also proposes a variety of seamless gloves with detailed technical characteristics as described in the paragraphs above.

DESCRIPTION OF THE PREFERRED EMBODIMENTS

Figure 1:
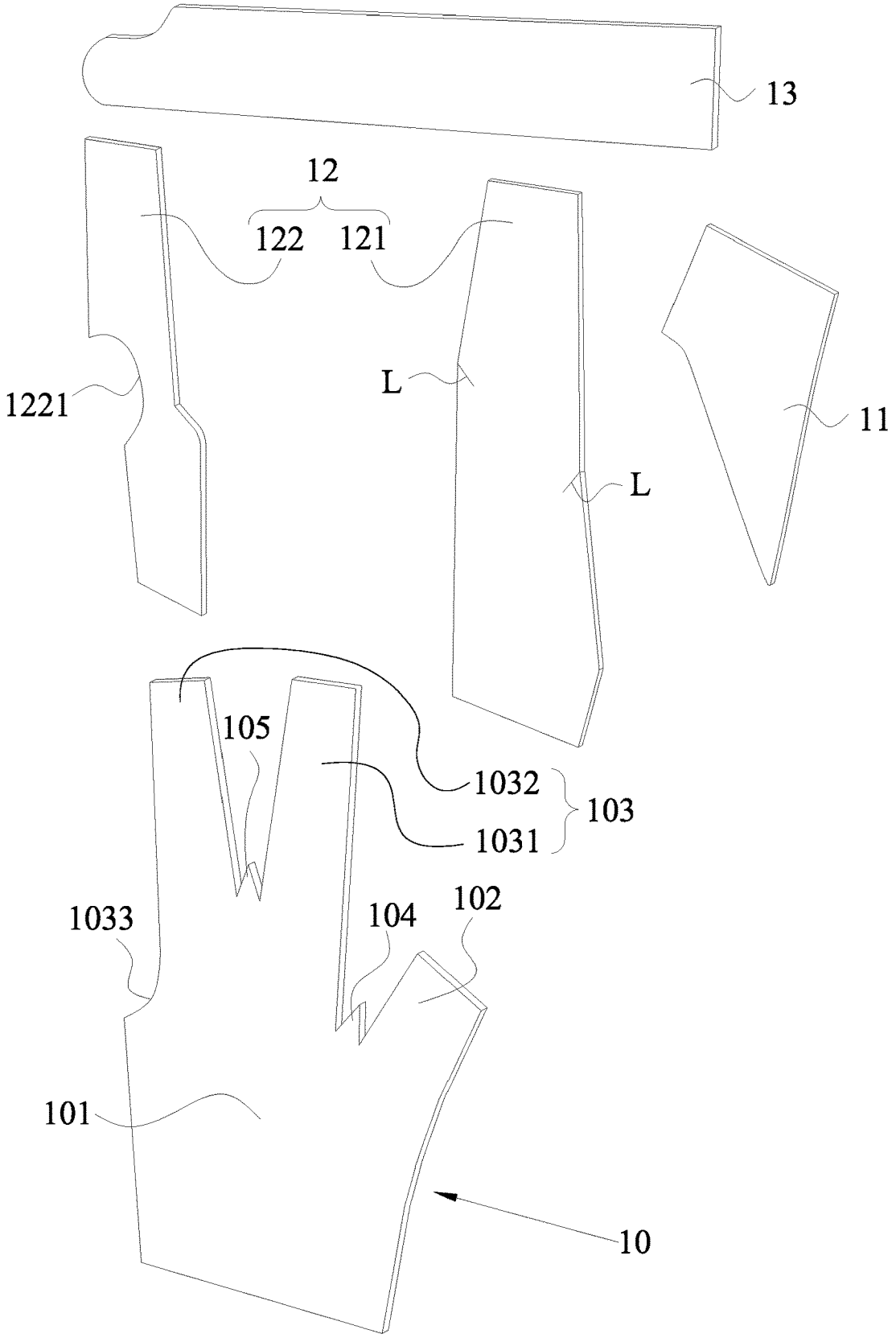
FIG. 1 is a schematic view showing a base fabric, a thumb fabric, a finger fabric and a wrist fabric in accordance with a preferred embodiment of the present disclosure.

The objectives, technical contents and features of this disclosure will become apparent in the following detailed description of the preferred embodiments with reference to the accompanying drawings.

In order to enable those having ordinary skill in the art to clearly understand the contents of the present disclosure, the following illustrations are provided for reference. The structural scale, proportion, size, shape, or application status shown in each of these drawings is only schematic, and is used to illustrate the technical characteristics of the present disclosure, but not intended to represent the actual structure design, as described in this specification.

With reference to FIGS. 1 to 4 for the schematic views of a preferred embodiment of the present disclosure showing a base fabric, a thumb fabric, a finger fabric and a wrist fabric, a semi-finished glove lining, the semi-finished glove lining viewing from another angle, and a seamless glove, the present disclosure discloses a seamless glove 1 including a base fabric 10, a thumb fabric 11, a plurality of finger fabrics 12 and a wrist fabric 13.

The base fabric 10 has a palm section 101, a thumb section 102 and a plurality of finger sections 103, the thumb section 102 and the finger sections 103 are connected to the palm section 101. A first fold section 104 is formed between the thumb section 102 and its adjacent finger section 103, and a second fold section 105 is formed between two adjacent finger sections. The thumb fabric 11 in in a shape corresponding to shape of the thumb section 102, the width of the thumb fabric 11 is greater than the width of the thumb section 102, an open finger end of the thumb fabric 11 is aligned precisely with an open finger end of the thumb section 102, and two sides of the thumb fabric 11 partially cover and adhere the thumb section 102.

The finger fabrics 12 are respectively configured to be corresponsive to the finger sections 103 and extended to a part of the palm section 101, and the positions where the finger fabrics 12 are extended to the palm section 101 are mutually stacked and adhered positions to completely cover the palm section 101. The open finger ends of the finger fabrics 12 are aligned precisely and respectively with the finger fabrics 12 of the finger sections 103, and two sides corresponding to the finger sections 103 partially cover and adhere the finger sections 103, and the finger fabrics 12 corresponding to two sides of the palm section 101 partially cover and adhere the palm section 101, and the first fold section 104 and the second fold section 105 press towards the palm section 101 to cover and adhere the finger fabrics 12, so that an external surface formed by adhering the base fabric 10, the thumb fabric 11 and the finger fabrics 12 is defined as a lining of a semi-finished glove 2. After the glove is turned inside, the lining of the semi-finished glove 2 is placed inside the glove. The wrist fabric 13 is strip shaped and adhered around a bottom edge of the semi-finished glove 2.

Figure 2:
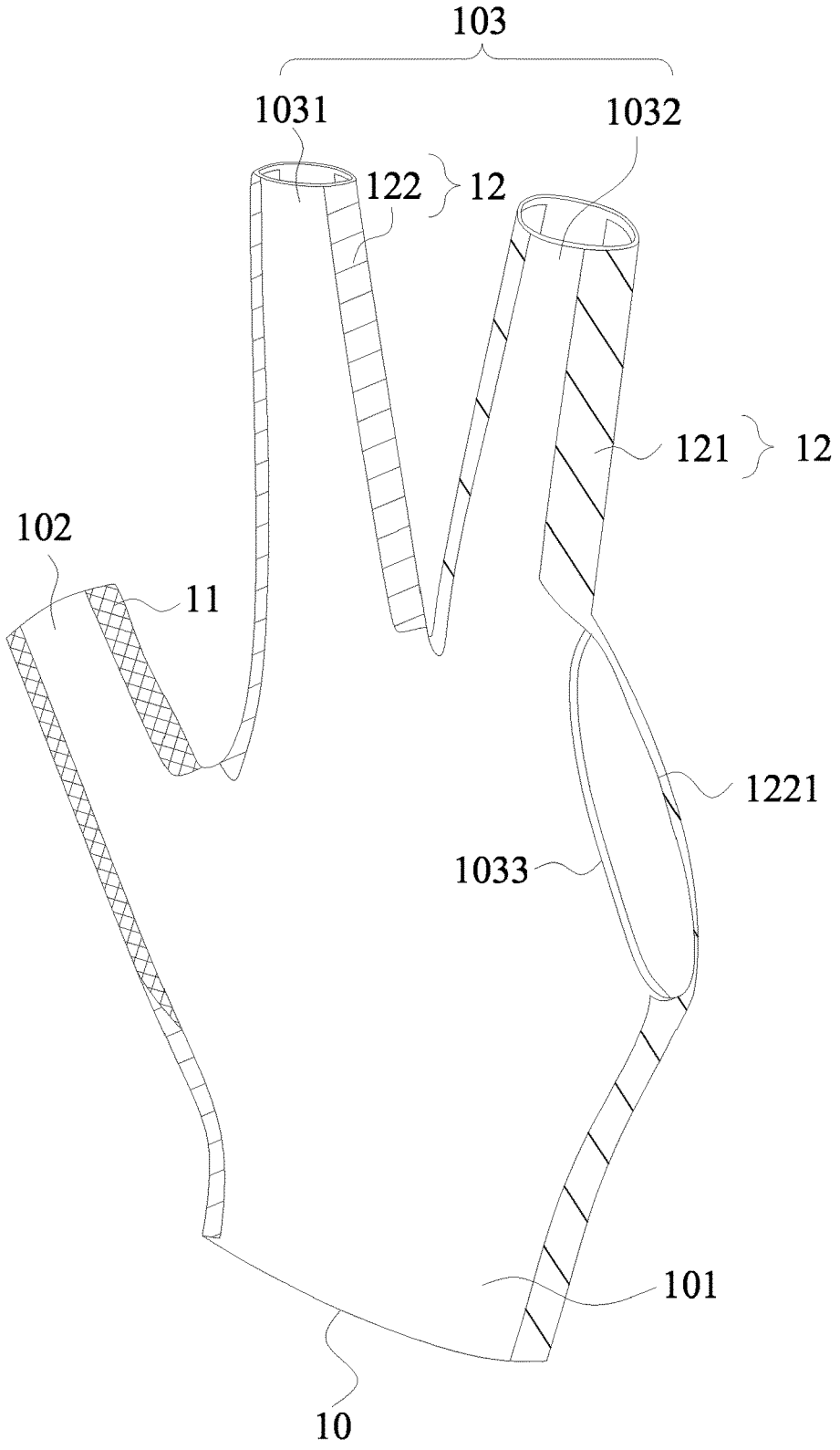
FIG. 2 is a schematic view showing a semi-finished glove lining in accordance with a preferred embodiment of the present disclosure.
Figure 3:
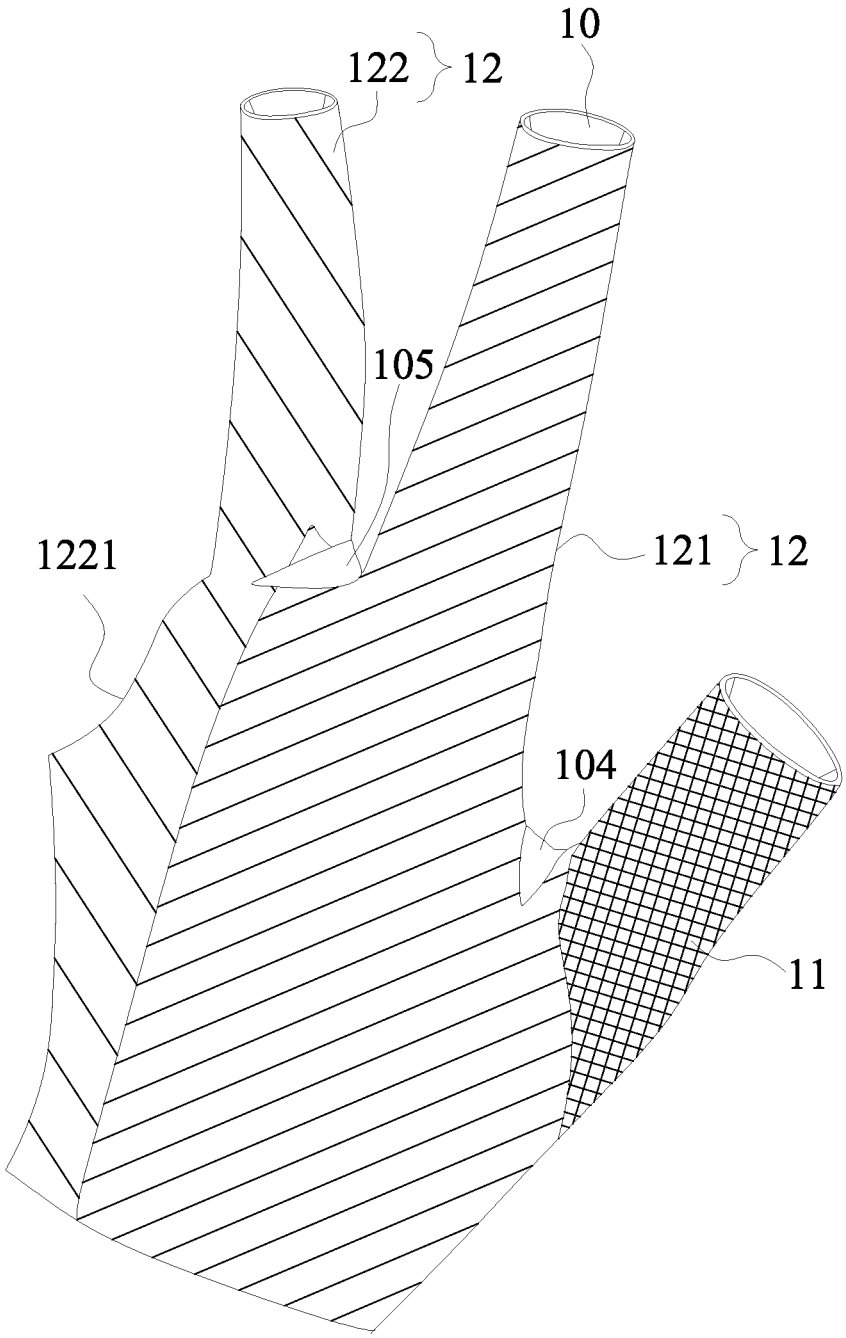
FIG. 3 is a schematic view showing a semi-finished glove lining in accordance with a preferred embodiment of the present disclosure viewing from another angle.
Figure 4:
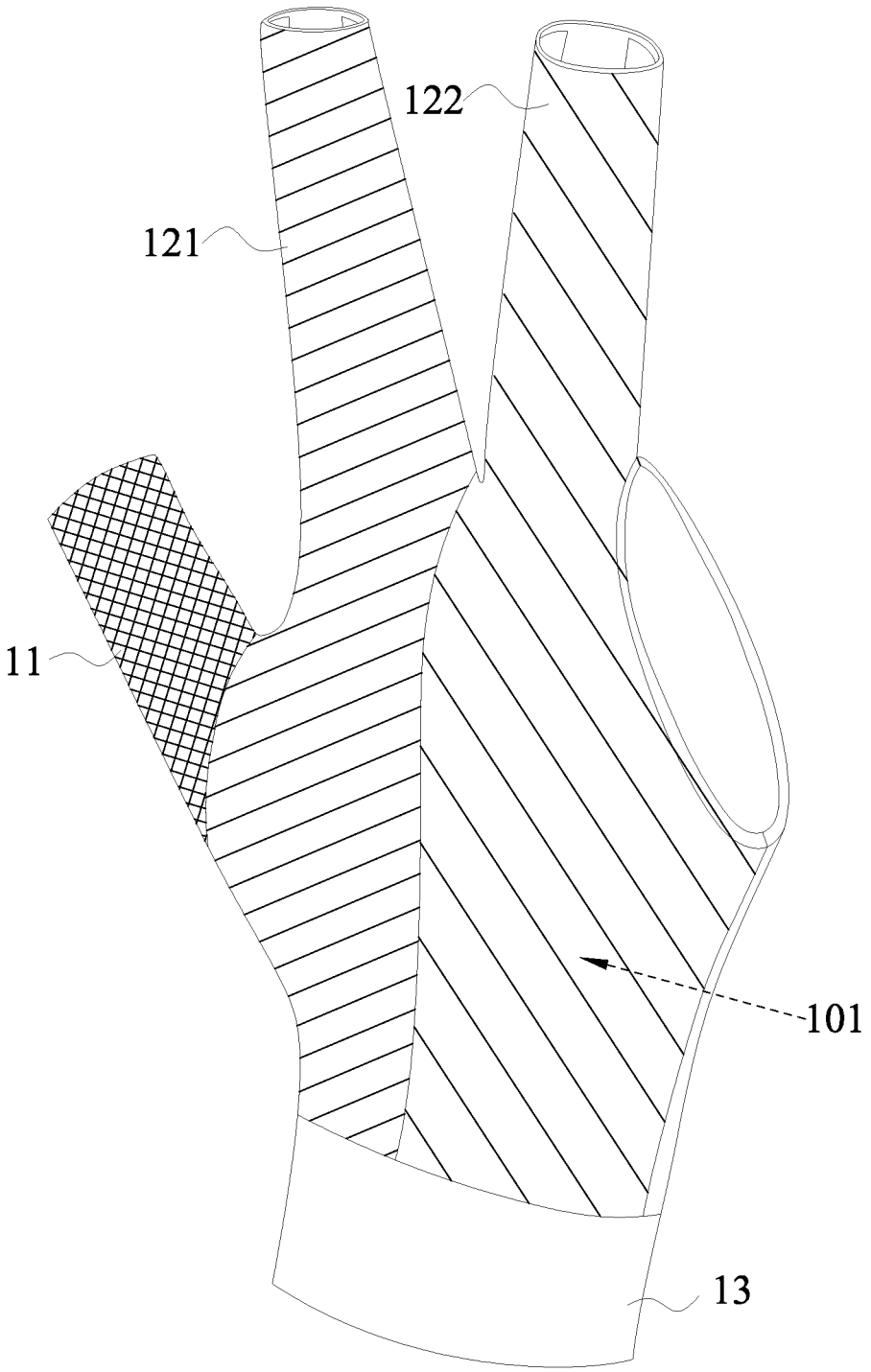
FIG. 4 is a schematic view showing a seamless glove in accordance with a preferred embodiment of the present disclosure.

In this way, the structure of the base fabric 10, the thumb fabric 11 and the finger fabrics 12 and the mutually adhesive characteristic can form the lining of the semi-finished glove 2 with the seamless characteristic. After the glove is turned inside out, the wrist fabric 13 is adhered around the bottom edge of the semi-finished glove 2 to form the seamless glove 1 with excellent wearing comfort. Specially, the base fabric 10, the thumb fabric 11, the finger fabrics 12 and the wrist fabric 13 are combined with each other by this adhesion method. Compared with the traditional gloves with stitches, the seamless glove 1 can eliminate the users' discomfort caused by the stitches, and allow users' hand to have better wearing comfort, and more flexibility to perform more precise hand movements after wearing the seamless gloves. For the purpose of illustration, FIGS. 2 to 4 show different sectional lines that illustrate the positions and performance of each fabric after adhesion. In FIG. 4, the palm section 101 of the base fabric 10 should be position in another viewing angle, so that the corresponding position of the palm section 101 is marked with a dotted line in the figure. The palm section 101 can refer to the same area on both sides of the base fabric 10.

In this embodiment, the finger sections 103 include an index-finger section 1031 and a middle-finger section 1032, and the finger fabrics 12 include an index-finger fabric 121 and a middle-finger fabric 122. Further, the middle-finger section 1032 connected to the palm section 101 is formed with a shallow arc section 1033, the middle-finger fabric 122 corresponding to the shallow arc section 1033 of the middle-finger section 1032 is formed with a deep arc section 1221. In this way, the three sections constitute a three-finger open-finger glove product, and after the base fabric 10 and the finger fabrics 12 are adhered, the seamless glove 1 forms the exposed areas of the ring finger and the little finger which are sandwiched between the shallow arc section 1033 and the deep arc section 1221. In other words, when a user wears the seamless glove 1 of this embodiment, the user's thumb is passed out from the structure formed by adhering the thumb fabric 11 and the thumb section 102, and the user's thumb is partially covered by the seamless glove 1; the user's index finger is passed out from the structure formed by adhering the index-finger fabric 121 and the index-finger section 1031, and the index finger is partially covered by the seamless glove 1; the middle finger is passed out from the structure formed by adhering the middle-finger fabric 122 and the middle-finger section 1032, and the middle finger is partially covered by the seamless glove 1; and the ring finger and the little finger are passed out from the opening formed after the middle-finger fabric 122 and the base fabric 10 are adhered and disposed adjacent to the middle finger and from the opening sandwiched between the deep arc section 1221 and the shallow arc section 1033 respectively. Of course, this arrangement is a preferred example only, and the finger sections 103 can include an index-finger section, a middle-finger section, a ring finger section and a little finger section. The finger fabrics 12 correspond to the index-finger fabric, the middle-finger fabric, the ring finger fabric and the little finger fabric, which are adhered to form a five-finger open-finger glove product.

In order to facilitate the adhesion of the index-finger fabric 121 and the base fabric 10, it is preferably to form two cut lines L on the index-finger fabric 121, which correspond to the junction of the index-finger section 1031 and the palm section 101. Therefore, when the index-finger fabric 121 is adhered to the base fabric 10, it is easier to partially cover and adhere the index finger section 1031 on two sides of the index-finger fabric 121 corresponding to the index-finger section 1031, to reduce the chance of forming wrinkles at the junction of the index-finger section 1031 and the palm section 101 of the base fabric 10 section. In FIG. 1, the length and position of the cut line L are for the purpose of illustration only, and can actually be adjusted according to the adhesion requirements.

In this embodiment, the first fold section 104 and the second fold section 105 are both in a triangular shape, so as to simplify the manufacture of the base fabric 10. For example, when the base fabric 10 is formed by cutting, the first fold section 104 and the second fold section 105 are made into triangular shapes. Compared with circular or rectangular shapes, the fabrics can be cut more quickly and easily to form the base fabric 10. The first fold section 104 and the second fold section 105 arranged in triangular shapes can improve the production efficiency and convenience of the base fabric 10.

Figure 5:
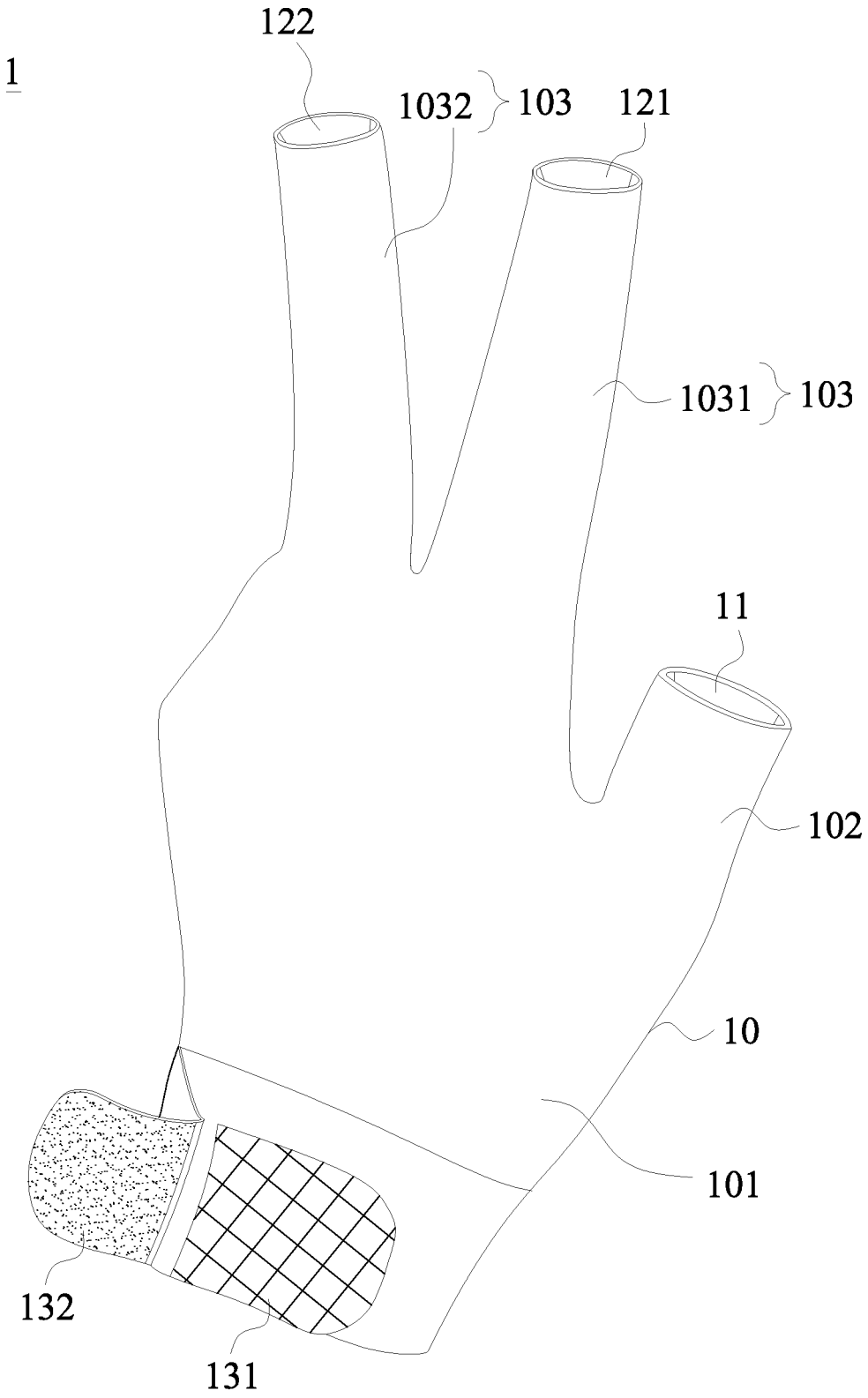
FIG. 5 is a schematic view showing a seamless glove with a child fastening part and a parent fastening part in accordance with a preferred embodiment of the present disclosure.

With reference to FIG. 5 for a seamless glove with a child fastening part and a parent fastening part in accordance with a preferred embodiment of the present disclosure, these parts are provided for improving the wearing stability of the seamless glove 1. Specifically, both ends of the wrist fabric 13 are provided with a child fastening part 131 and a parent fastening part 132 respectively, so that after a user wears the seamless glove 1, the child fastening part 131 and the parent fastening part 132 can strengthen the tight fit level between the seamless glove 1 and the user's wrist to reduce the chance of having the gloves to be fallen off.

In the structure of the child fastening part 131 and the parent fastening part 132, the child fastening part 131 and the parent fastening part 132 can act like buttons, and the child fastening part 131 can include a plurality of child fastening parts spaced apart from each other, and the parent fastening part 132 can include a plurality of parent fastening parts spaced apart from each other, and the child fastening parts 131 and the parent fastening parts 132 can be fastened with each other to fit the size of the user's wrist and improve the applicability of the seamless glove 1. In addition, if the convenience of use and manufacture is taken into account, the child fastening part 131 and the parent fastening part 132 may be hook and loop fasteners, so that the child fastening part 131 and the parent fastening part 132 can be quickly adhered or separated. Similarly, if the child fastening part 131 and the parent fastening part 132 are hook and loop fasteners, the length of the hook and loop fasteners can be designed to fit the user's wrist and adjust the size of the seamless glove 1 at the wrist.

In addition, if the applicable areas and environments of the seamless and glove 1 are taken into account, the base fabric 10, the thumb fabric 11, and the finger fabrics 12 can be made of heating materials to provide users with sufficient warming effect in addition to the protective function and to facilitate the use of the seamless glove 1 in colder climatic environments.

In summation of the description above, the special structure and method of adhering the base fabric, thumb fabric, finger fabric and wrist fabric to each other, a glove product with a seamless structure is produced, so that users can have excellent wearing comfort due to the seamless structure. Specifically, the thumb fabric and the finger fabrics partially cover and adhere the thumb section, finger section, and palm section of the base fabric, and make the thumb fabric and the finger fabric to be tightly and stably adhered and fixed to the base fabric, so that after the three fabrics are adhered and fixed to each other by this special method, a semi-finished glove lining is formed. Finally, the glove is turned inside out, and the wrist fabric is adhered around the semi-finished glove to form the seamless glove. The present disclosure discloses a novel technical solution of a glove structure with high wearing comfort. Further, the present disclosure further discloses various structural modes. In an embodiment, for example, the finger section may include an index finger section and a middle-finger section, the finger fabric may include an index finger fabric and a middle-finger fabric, the middle-finger section has a shallow arc section, and the middle-finger fabric has a deep arc section to form a three-finger covering-type glove. In order to facilitate the adhesion of the index-finger fabric to the base fabric, the index-finger fabric can be formed with cut lines. If the convenience and efficiency of the manufacture of the base fabric are taken into account, the first fold section and the second fold section can be both in a triangular shape. To improve the wearing stability of the seamless glove, the wrist fabric may have a child fastening part and a parent fastening part, both are hook and loop fasteners. To improve the applicability of the seamless glove, the fabrics may be made of heating materials to facilitate applications in colder climatic environments.

What is claimed is:

1. A glove with stitchless seams, comprising:

a base fabric, having a palm section, a thumb section, and a plurality of finger sections, the thumb section and the plurality of finger sections being coupled to the palm section, wherein a first fold section is formed between the thumb section and an adjacent finger section, a second fold section is formed between two adjacent finger sections;

a thumb fabric, in a shape corresponding to a shape of the thumb section and having a width greater than a width of the thumb section, an open finger end of the thumb fabric being aligned precisely with an open finger end of the thumb section, and two sides of the thumb fabric partially covering and adhering to the thumb section;

a plurality of finger fabrics, respectively, connected to the plurality of finger sections, and a portion of each of the plurality of finger fabrics extended to the palm section, the portion of each of the plurality of finger fabrics is mutually stacked and adhered to each other at an edge of the portion of each of the plurality of finger fabrics to completely overlap the palm section, wherein an open finger end of the plurality of finger fabrics is corresponding to and aligned precisely with an open finger end of the plurality of finger sections for the plurality of finger fabrics to connect to the plurality of finger sections, and the plurality of finger fabrics, corresponding to two sides of the plurality of finger sections, partially cover and adhered to the plurality of finger sections, an edge of each of the plurality of finger fabrics connected and adhered to a corresponding side of the palm section, and the first fold section and the second fold section press towards the palm section to cover and adhere the plurality of finger fabrics; and a wrist fabric, which is strip-shaped and adhered around a bottom edge of the glove, wherein the base fabric, the thumb fabric, the plurality of finger fabrics, and the wrist fabric are, respectively, a sheet-shaped structure and are directly adhered to each other to form the glove, and the plurality of finger sections only includes an index-finger section and a middle-finger section, and the plurality of finger fabrics only includes an index-finger fabric and a middle-finger fabric.

2. The glove with stitchless seams according to claim 1, wherein the middle-finger section is coupled to the palm section to form a shallow arc section, and the middle-finger fabric, corresponding to the shallow arc section of the middle-finger section, is formed with a deep arc section.

3. The glove with stitchless seams according to claim 2, wherein the index-finger fabric is provided with two cut lines which overlie a junction of the index-finger section and the palm section.

4. The glove with stitchless seams according to claim 3, wherein the first fold section and the second fold section are both in a triangular shape.

5. The glove with stitchless seams according to claim 4, wherein the wrist fabric comprises a child fastening part and a parent fastening part disposed at two ends thereof respectively.

6. The glove with stitchless seams according to claim 5, wherein the child fastening part and the parent fastening part are hook and loop fasteners.

* * * * *